United States Patent [19]

Miller

[11] 4,188,530

[45] Feb. 12, 1980

[54] LIGHT-SHIELDED EXTENDED-RANGE STATIC ELIMINATOR

[75] Inventor: Bruce H. Miller, Hatfield, Pa.

[73] Assignee: The Simco Company, Inc., Lansdale, Pa.

[21] Appl. No.: 960,578

[22] Filed: Nov. 14, 1978

[51] Int. Cl.[2] ..... H01T 19/04; H01J 27/00

[52] U.S. Cl. ..... 250/324; 250/423 R; 250/427; 361/213

[58] Field of Search ..... 55/138, 155; 209/127 R; 361/213, 230; 250/324, 325, 423 R, 427

[56] References Cited

U.S. PATENT DOCUMENTS

| | | | |
|---|---|---|---|
| 1,169,428 | 1/1916 | Rogers | 361/213 |
| 3,643,128 | 2/1972 | Testone | 361/230 |
| 3,777,158 | 12/1973 | Kamogawa et al. | 250/324 |
| 4,092,543 | 5/1978 | Levy | 250/423 R |

*Primary Examiner*—Harold A. Dixon
*Attorney, Agent, or Firm*—Stanley Bilker

[57] ABSTRACT

An extended range static eliminator for impinging a stream of ionized air upon light-sensitive articles to be neutralized includes a housing for directing air through an opening therein toward the articles and a plurality of pointed discharge electrodes supported in the housing across the opening and facing opposite the air stream. The electrodes are preferably capacitively coupled to the high side of an A.C. power source to reduce likelihood of arcing while a conductive casing connected to the other side of the power source partially encircles the discharge electrodes to shield the high voltage field at the base of the electrodes from the ions emitted from the points thereof and further shield the sensitive articles from corona developed around the points.

6 Claims, 6 Drawing Figures

FIG. 1
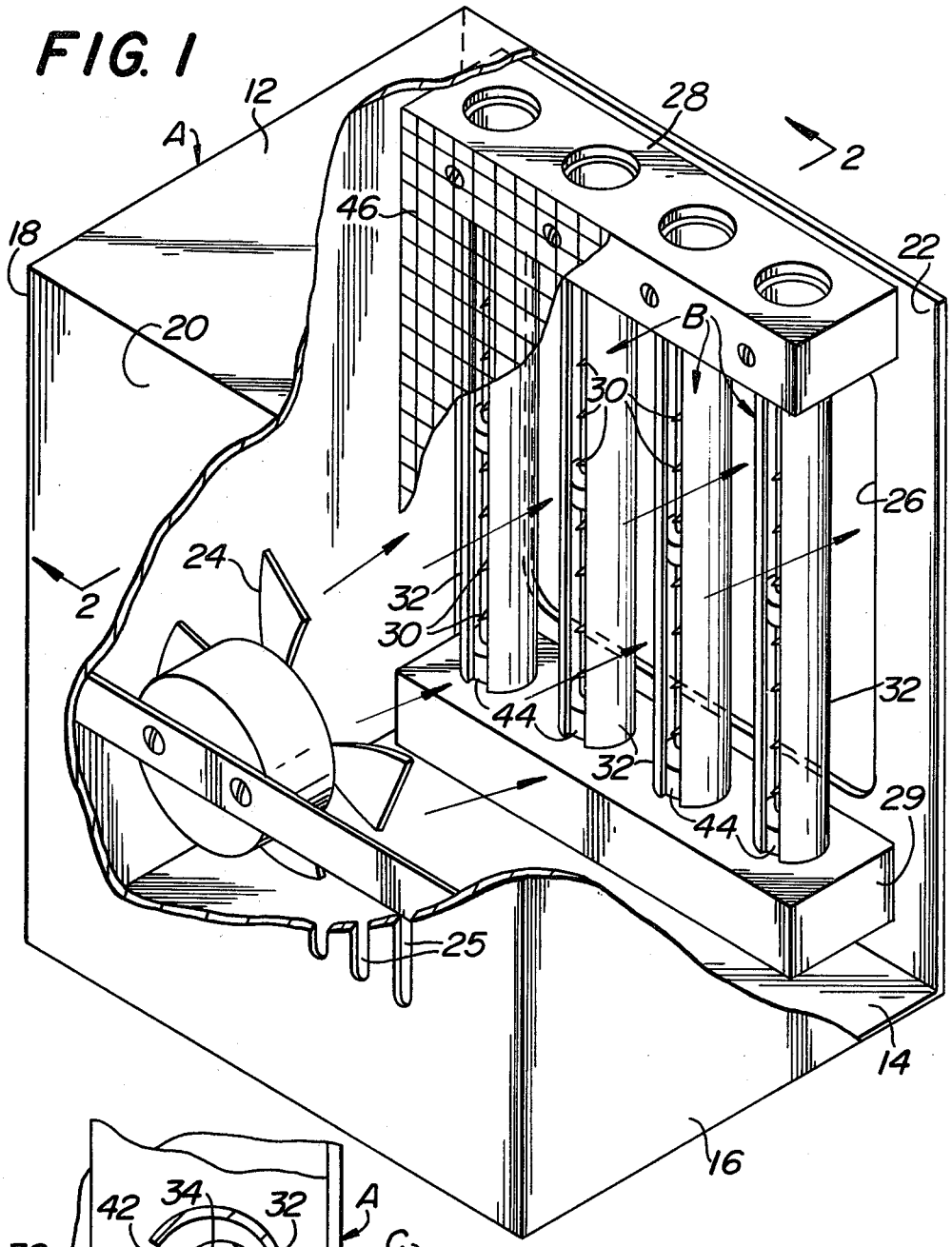
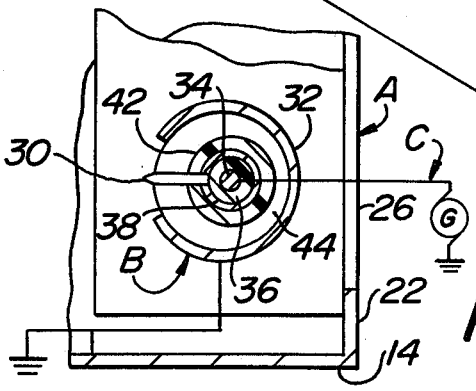
FIG. 3

FIG. 2
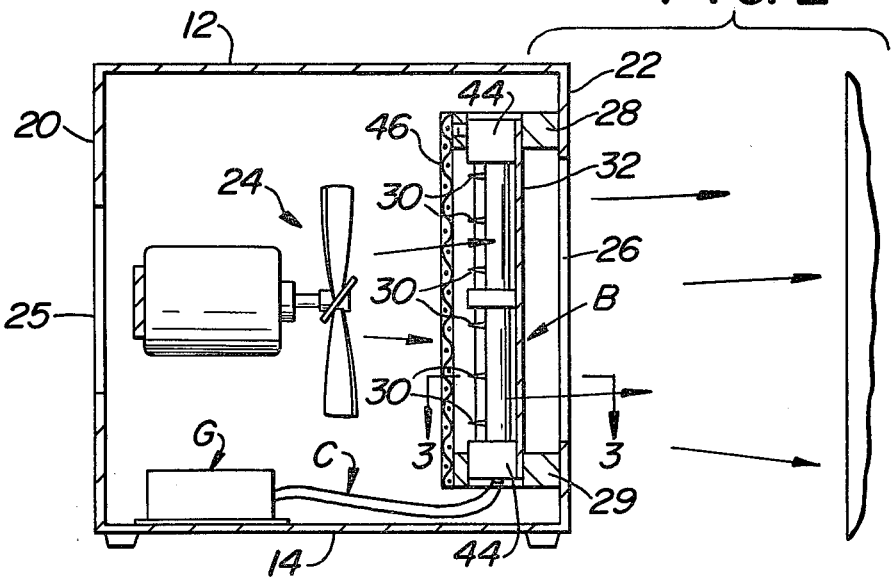
FIG. 4
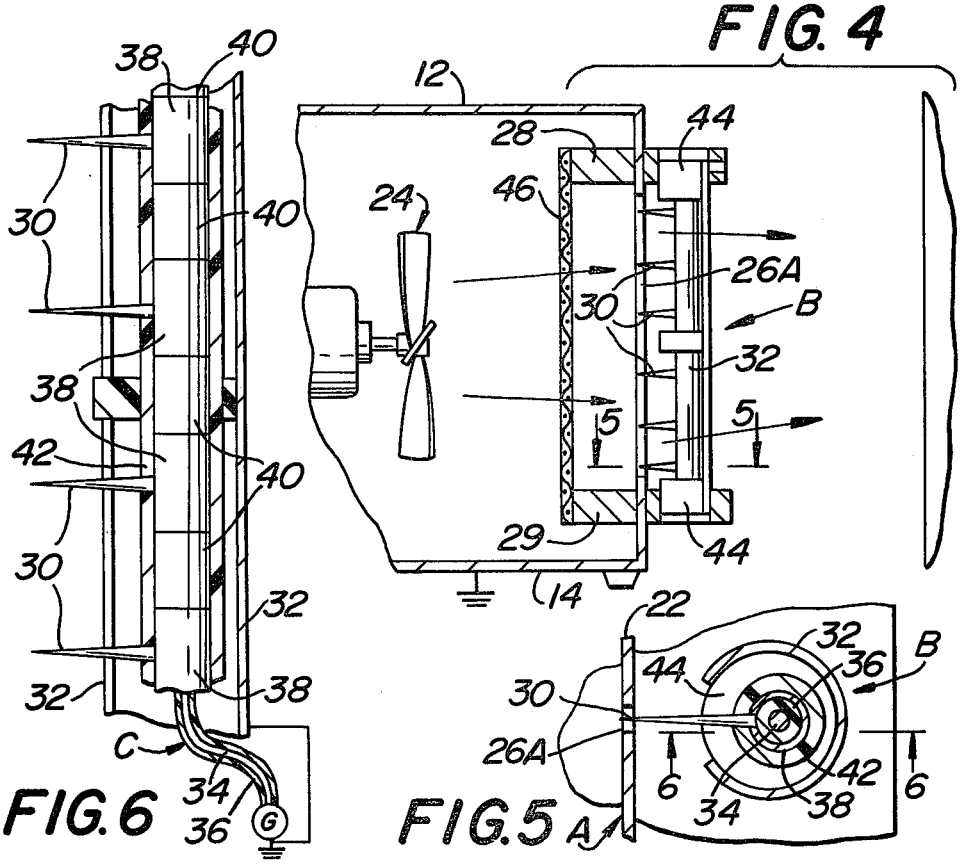
FIG. 6
FIG. 5

LIGHT-SHIELDED EXTENDED-RANGE STATIC ELIMINATOR

BACKGROUND OF THE INVENTION (1) Field of the Invention

This invention relates to static neutralizers, and more particularly relates to corona discharge devices in which one side of an A.C. high voltage power source is connected to a discharge electrode, usually of pointed disposition, and the other side connected to a conductive member or apertured casing adjacently spaced with respect to the discharge electrode to effect emission of ions of both polarities in the gap therebetween. This invention is especially concerned with static eliminators of the "shockless" type wherein the discharge electrodes are capacitively coupled, either indivdually or in groups, to the high voltage source in order to limit the short circuit current which can be drawn from a point so that the extent of arcing or electrical shock can be minimized. The present invention is specifically adapted to be used as an extended range static eliminator for impinging a stream of ionized air over considerable distances upon light sensitive articles to be neutralized.

(2) Prior Art

As is well known, static eliminators are devices for producing both positive and negative ions for the neutralization of articles which have been charged to a particular polarity, usually as a result of electrostatic, frictional, electrical or other created forces. When an A.C. high voltage of fairly high magnitude is applied across the discharge points and the grounded casing of such static bars, ions of each polarity are emitted. In a direct connected bar, such as shown in U.S. Pat. No. 3,137,806 or U.S. Pat. No. 3,156,847 (Air Gun), the discharge electrodes are coupled directly to the output of the A.C. high voltage while in a capacitively coupled static bar, such as shown in U.S. Pat. No. 3,120,626 or U.S. Pat. No. 3,179,849 (Air Gun), a capacitance is included between the discharge points and the power source in order to limit the short circuit current that can be drawn from a point, thereby minimizing arcing or shock. In either case, it can be observed that a breeze or stream of air is produced in the same direction as the points by virtue of the high voltage field created between the points, the electrode bases upon which the points are mounted and the ground electrode or casing mounted adjacent the sharp ends of the points. Usually where an extended range ionization is desired, an air stream is blown across the points in the same direction they are facing so that the ion breeze will be reinforced by the air stream. See U.S. Pat. No. 4,092,543. However, in the instance where the ion emission must be directed toward light sensitive articles, such as film or plates with photographic emulsions, it is necessary to shield the articles from corona glow developed around the points because such radiation would expose the film or emulsion prematurely.

If the static bars are entirely enclosed within a blower housing to block off the corona radiation from the sight of the articles, it has been found that the useful dual ion emission is dissipated within the housing long before the ions can emerge therefrom for impingement upon the articles themselves. In the development of the present invention, it was proposed to have the points of the discharge electrodes positioned adjacent the grounded blower housing and oriented in a direction opposite to that of the blower's air stream. An open bar construction was opted for because of the belief that the partially encircling casing of the conventional static bar construction would cup the flow of air and hence interfere with pattern of the blown air stream. However, it was found that in an open bar construction the air stream could neither overcome the ion breeze nor the high voltage field created about the bar bases upon which the points were mounted.

The present invention contemplates the use of a tubular casing, similar in many respects to the conventional grounded housing employed in the past for supporting the static bars, to act as both a shield for blocking the view of corona discharge emitted from the points (i.e. by orienting said points opposite to the direction of the blower air stream), and also as a shield about the high voltage bar assemble supporting the points themselves, thereby enabling ions emitted from the points to be carried along by the blown air stream per se.

SUMMARY OF THE INVENTION

It is therefor an object of this invention to provide an extended range static eliminator for neutralizing light sensitive articles.

Another object of this invention is to provide a light-free static eliminator wherein ion emission which is directed opposite to a blown air stream may be freely carried along in said air stream.

Still another object of this invention is to provide an extended range static eliminator in which light sensitive articles may be neutralized at great distances without corona radiation exposure.

Yet still another object of this invention is to provide a light-free, extended-range static eliminator in which ionized air entrapment within a blower housing is avoided.

Other objects of this invention are to provide an improved device of the character described which is easily and economically produced, sturdy in construction, and highly efficient and effective in operation.

DESCRIPTION OF THE DRAWINGS

With the above and related objects in view, this invention consists of the details of construction and combination of parts as will be more fully understood from the following detailed description when read in conjunction with the accompanying drawings in which:

FIG. 1 is a perspective view, and partly broken away, of an extended-range, light-free static eliminator embodying this invention.

FIG. 2 is a sectional view taken along lines 2—2 of FIG. 1.

FIG. 3 is a sectional view taken along lines 3—3 of FIG. 2.

FIG. 4 is a side sectional view of another embodiment of this invention.

FIG. 5 is a sectional view taken along lines 5—5 of FIG. 4.

FIG. 6 is a sectional view taken along lines 6—6 of FIG. 5.

DETAILED DESCRIPTION

Referring now in greater detail to the drawings in which similar reference characters refer to similar parts, there is shown a housing, generally designated as A, for directing a stream of air across a set of static neutralizers, generally designated as B, whereby an ionized air stream may be impinged upon light sensitive articles at relatively great distances.

The housing A includes top and bottom walls 12, 14, side walls 16, 18, a back wall 20 and a front wall 22. The housing is preferrably made of steel or other suitable sheet metal, but the general configuration of the housing is relatively unimportant so long as it provides a sturdy enclosure for supporting a blower or fan 24 in a convenient manner as well as the static neutralizers B. Louvres 25 may be incorporated in the rear wall 20 to enable air to enter the housing while an enlarged opening 26 in the front wall 22 permits the ionized air to exit for impingement upon the articles to be neutralized.

The static neutralizers B comprise a series of preferrably capacitively coupled discharge devices which are supported in spaced disposition with each other across the opening 26 by means of suitable brackets 28 and 29 so that the points 30 of the discharge electrodes face toward the air stream (and away from the articles to be neutralized). A "shockless" configuration, such as shown in U.S. Pat. No. 3,120,626 is desirable in order to minimize arcing should short circuiting across the points 30 and the static bar casing 32 occur.

Referring now to FIGS. 3, 5 and 6, each static neutralizer B includes an insulated cable C having a central wire conductor 34 jacketed within an insulating cover or skin 36, the conductor 34 being connected to the high voltage side of an A.C. generator G. A plurality of conductive rings 38 and dielectric sleeves or spacers 40 are alternately disposed longitudinally along the cable C slidably concentric with respect to the conductor 34. A tubular jacket 42 of dielectric material is co-axially disposed with respect to the rings 38 and sleeves 40 and defines a rigid internal mount for the discharge electrodes 30. The discharge electrodes 30 are in the form of pointed needles whose bases are pressed into firm electrical contact with the conductive rings 38. The ends of the tubular jacket 42 are retained within collars 44 which define supports for holding the conductive casing 32 in fixed disposition about the discharge electrodes. It is to be especially noted that the form of the casings 32 is such as to substantially enclose the central portion of the discharge assembly (i.e. the high voltage mount) from which the needles 30 project. The grounded casings 32 may be generally tubular in configuration and include a longitudinally extending slot in the cylindrical wall, as illustrated, or embody a plurality of circular apertures (not shown) through which the points 30 of the discharge needles pass.

The high voltage A.C. power supply G is conventional and is adapted to furnish from about 2,500 to 15,000 volts A.C. at low amperage. The hot side of the power supply is connected to the discharge electrodes 30 either capacitively, as shown, by way of rings 38 or directly (as illustrated in U.S. Pat. No. 3,137,806) while the other side of the power source is connected to the housing A and casings 32. When the A.C. power supply G is so connected, ions of both polarities are emitted in the air space between the points of the discharge needles 30 and the next adjacent ground.

In the embodiment shown in FIGS. 1, 2 and 3, the ion emission occurs between the points 30 of the discharge electrodes and the edges of the longitudinal slots in the individual casings 32. Although the direction of the air blown by fan 24 is opposite to the direction of the ion breeze from the static eliminators B, sufficient ions are thrown between the spaces between the casings 32 to allow them to be carried through the opening 26 of housing A. That is, each of the grounded casings 32 acts as a shield about the high voltage conductor 34 and the capacitively coupled rings 38 thereof so as to prevent the high voltage field emanating from the central mount from acting as a barrier to the passage of ions therebetween. A suitable screen 46 supported internally across the brackets 28 and 29 filters the air blown by the fan 24 in a convenient manner.

In the embodiment shown in FIGS. 4, 5 and 6, the face 22 of the housing A has a plurality of slits 26A and the static eliminators B are mounted on the outside of the grounded housing A. In this embodiment, the needles 30 of the discharge electrode are longer and project beyond the perimeter of the casings 32 so that the needle points extend into the slits 26A substantially flush with the plane of the housing face 22. As may be readily apparent, the high voltage field between the needle points 30 and the edges of the slits 26A produces an ion emission within said slits rather than in the slot of the casing 32. However, the casings 32, which also are at ground level, act as a shield between the high voltage on the central portion of the discharge electrode (i.e. the wire conductor 34 and rings 38) and the ions themselves, thereby defining a field which nullifies the effect of the central portion upon the ions emitted between the points 30 and the housing slits 26A.

Although this invention has been described in considerable detail, such description is intended as being illustrative rather than limiting, since the invention may be variously embodied without departing from the spirit thereof, and the scope of the invention is to be determined as claimed.

What is claimed is:

1. A light-shielded, extended-range static eliminator for impinging a stream of ionized air upon light sensitive articles to be neutralized comprising a housing having an opening therein, blower means for directing a stream of air through the opening, a plurality of discharge electrodes supported in said housing across the opening thereof so that the electrodes face in an opposite direction to the air stream, including means for coupling said discharge electrodes to one side of an A.C. high voltage source, and a generally tubular conductive casing connected to the other side of the high voltage power source and at least partially encircling said means for coupling so as to shield the high voltage field thereof from ions emitted in the air gap between said discharge electrodes and said conductive casing and further shielding the articles exposed to the ionized air stream from corona developed in the air gap.

2. The static eliminator of claim 1 wherein said means for coupling is capacitive.

3. The static eliminator of claim 1 wherein said conductive casing includes a longitudinal slot along the periphery thereof.

4. The static eliminator of claim 3 wherein said discharge electrodes comprise elongated needles.

5. The static eliminator of claim 4 wherein the points of the needles are coextensive with the periphery of the longitudinal slot.

6. The static eliminator of claim 4 wherein said housing includes a plurality of slits defining the opening thereof and the points of the needles project beyond the periphery of the longitudinal slot into flush disposition with the slits.

* * * * *